US008910440B2

(12) United States Patent
Calisse

(10) Patent No.: US 8,910,440 B2
(45) Date of Patent: Dec. 16, 2014

(54) CONNECTION SYSTEM FOR PREFABRICATED THERMAL BREAK PANELS

(76) Inventor: Carlo Calisse, Monza (IT)

( * ) Notice: Subject to any disclaimer, the term of this patent is extended or adjusted under 35 U.S.C. 154(b) by 222 days.

(21) Appl. No.: 13/124,895

(22) PCT Filed: Oct. 20, 2009

(86) PCT No.: PCT/IB2009/007202
§ 371 (c)(1),
(2), (4) Date: Apr. 19, 2011

(87) PCT Pub. No.: WO2010/052535
PCT Pub. Date: May 14, 2010

(65) Prior Publication Data

US 2011/0197529 A1 Aug. 18, 2011

(30) Foreign Application Priority Data

Nov. 7, 2008 (IT) ..... MI2008A1971

(51) Int. Cl.
*E04C 2/22* (2006.01)
*E04C 2/284* (2006.01)
*E04C 2/04* (2006.01)

(52) U.S. Cl.
CPC ..... *E04C 2/044* (2013.01); *E04C 2002/046* (2013.01)
USPC ..... 52/426; 52/379; 52/565

(58) Field of Classification Search
USPC ..... 52/309.11, 379, 426, 562, 565
See application file for complete search history.

(56) References Cited

U.S. PATENT DOCUMENTS

| | | | | | |
|---|---|---|---|---|---|
| 836,589 | A | * | 11/1906 | Layfield et al. | 52/565 |
| 861,215 | A | * | 7/1907 | Kahn | 52/654.1 |
| 941,616 | A | * | 11/1909 | Chapman | 52/565 |
| 1,035,206 | A | * | 8/1912 | Lewen | 52/422 |
| 1,302,727 | A | * | 5/1919 | Thomas | 52/713 |
| 1,488,726 | A | * | 4/1924 | Alexander et al. | 52/715 |
| 1,596,404 | A | * | 8/1926 | Clouser | 52/562 |
| 1,620,834 | A | * | 3/1927 | Rhodes | 52/220.1 |
| 1,699,554 | A | * | 1/1929 | Wigglesworth | 52/712 |

(Continued)

FOREIGN PATENT DOCUMENTS

| | | | |
|---|---|---|---|
| DE | 20 2006 012 881 | 1/2007 | |
| WO | WO 03/038207 | 5/2003 | |
| WO | WO 2004016874 A1 * | 2/2004 | E04C 2/04 |

*Primary Examiner* — Robert Canfield
*Assistant Examiner* — Charissa Ahmad
(74) *Attorney, Agent, or Firm* — Jacobson Holman Herskovitz, PLLC.

(57) ABSTRACT

The present invention describes a connection system for prefabricated panels of the type comprising at least two outer concrete layers (12, 14), provided with metallic reinforcement (18), and an intermediate layer (16) made of heat-insulating material, arranged between the two outer concrete layers (12, 14). The system comprises a plurality of plate-like connection elements (10) having such a length (L) as to allow them to extend, in an orthogonal direction with respect to the panel's development plan, through the heat-insulating layer (16) and to partially penetrate inside the outer concrete layers (12, 14). Each connection element (10) is provided, at two opposed terminal ends, with respective hooking means (22, 24) to the outer concrete layers (12, 14). At least one (24) of the hooking means provided at the opposed terminal ends of each connection element (10) is made up of two distinct C-shaped edges (24A, 24B), side by side and parallel to each other. The C-shaped edges (24A, 24B) are capable of hooking onto respective bars (20) provided on the metallic reinforcement (18) of at least one (12) of the panel's outer concrete layers.

6 Claims, 5 Drawing Sheets

(56) References Cited

U.S. PATENT DOCUMENTS

| | | | | | |
|---|---|---|---|---|---|
| 1,924,724 | A | * | 8/1933 | Olney | 52/379 |
| 2,851,875 | A | * | 9/1958 | Astorga | 52/289 |
| 2,919,572 | A | * | 1/1960 | Salzi | 52/381 |
| 3,805,471 | A | * | 4/1974 | De Schutter | 52/714 |
| 4,149,349 | A | * | 4/1979 | Nilsen et al. | 52/381 |
| 4,283,896 | A | * | 8/1981 | Fricker et al. | 52/410 |
| 4,348,847 | A | * | 9/1982 | Jukes | 52/426 |
| 4,624,089 | A | * | 11/1986 | Dunker | 52/410 |
| 4,702,053 | A | * | 10/1987 | Hibbard | 52/309.7 |
| 4,703,602 | A | * | 11/1987 | Pardo | 52/564 |
| 4,768,324 | A | * | 9/1988 | Hibbard | 52/742.14 |
| 4,835,928 | A | * | 6/1989 | Scott | 52/426 |
| 5,440,845 | A | * | 8/1995 | Tadros et al. | 52/309.12 |
| 6,405,505 | B1 | * | 6/2002 | Alberti | 52/562 |
| 8,033,759 | B2 | * | 10/2011 | Davidsaver et al. | 405/284 |
| 2007/0217870 | A1 | * | 9/2007 | Davidsaver et al. | 405/284 |
| 2008/0104911 | A1 | * | 5/2008 | Jarvie et al. | 52/309.1 |

* cited by examiner

| Property | Standard | Value | Unit of measurement |
|---|---|---|---|
| 1) Specific Gravity | ASTM D792 | 1.75 | $g/cm^3$ |
| 2) Water absorption | ISO 62 | ≤ 0.4 | % |
| 3) Vitreous content (by weight) | ISO 1172 | 60 | % |
| 4) Barcol Hardness | ASTM D 2583 | ≥ 50 | °B |
| 5) a) Modulus of elasticity (in length) | ASTM D 638 | ≥ 26 | GPa |
| b) Shear resistance (in length) | ASTM D 638 | ≥ 400 | MPa |
| 6) a) Modulus of elasticity (in length) | ASTM D790 | ≥ 15 | GPa |
| b) Bending resistance (in length) | ASTM D790 | ≥ 400 | MPa |
| 7) Thermal expansion coefficient (in length) | ASTM D 696 | $11 \times 10^{-6}$ | $k^{-1}$ |
| 8) Thermal conductivity | ASTM C177 | 0.35 | W/mK |

Tolerances of the values given above: ±10%

The size tolerances adhere to the standard ASTM D3917

The surface quality adheres to the standard ASTM D4385 Level II

Fig. 4

CONNECTION SYSTEM FOR PREFABRICATED THERMAL BREAK PANELS

This is a national stage of PCT/IB09/007,202 filed Oct. 20, 2009 and published in English, which claims the priority of Italian number MI2008A001971 filed Nov. 7, 2008, hereby incorporated by reference.

The present invention refers to the technical field of prefabricated constructions and, more in particular, it refers to a connection system for prefabricated so called "thermal break" panels.

As it is known, a thermal break panel for civil and industrial constructions is substantially made up of three layers arranged as a "sandwich": a structural load-bearing part on the inner side of the building, usually lightened and made from concrete, an intermediate layer made from thermal insulation material, which constitutes the "thermal break" and which usually comprises slabs of expanded polystyrene, and a layer arranged on the outer side of the building, which is also made from concrete and which usually has lining function.

The panel is held together by particular connecting systems, which must allow the structural part to bear the layer of outer lining with as little strain as possible, so as to keep the dimensions and the cost as low as possible, and it must allow the layer of lining itself to suffer a different thermal expansion with respect to that of the structural part, so as to avoid tension cracking, warping of the panel and other problems. In other words, the connection systems connect the two layers of concrete of the panel, passing through the thermal insulating layer, to support the outer lining layer.

It is thus clear that, in a thermal break panel, the less heat is transmitted between the two concrete parts, the better the overall heat efficiency of the panel itself and, thus, the smaller its thickness and cost.

Currently, there are numerous types of connection systems for prefabricated panels on the market. Some systems foresee metal connection elements, which can be provided with or without elastic means able to ensure a suitable thermal expansion. Other systems, on the other hand, foresee connecting plugs, made from thermoplastic material, which are "buried" in the concrete in the step of manufacturing the panel.

The known type connection systems however, can have a series of drawbacks, which sometimes affect the structural stability of the prefabricated panel in which they are inserted.

For example, some connection systems discharge the weight of the lining layer on the structural part on a single point, inducing a substantially concentrated strain. This situation, in the designing step of the panel, imposes an important sizing of the structure at least in the area of maximum strain concentration, but in practice on the entire panel. However, as far as the thrusts due to thermal expansion are concerned, some connection systems transfer them directly onto the structural part of the panel. Consequently, the strain which is induced by thermal expansion can also reach particularly high values (5÷6 mm for a vertical panel about 10 m high).

Similarly, on the lining layer carried, by the connection system, the transmission of stresses caused by the weight and by the thermal expansions can induce the formation of tension cracking and other surface anomalies on the lining layer itself.

In addition, some known type connection systems, in this case, the connecting plugs made from thermoplastic material, can have problems hooking onto the structural part of the panel, as well as a reduction of their performances in function of a considerable increase of the temperature and especially in the case of fire. On the other hand, other connection systems, especially those made from metal, can be particularly complicated and costly, as well as creating substantial thermal bridges between the concrete layers of the panel.

The general purpose of the present invention is therefore that of making a connection system for prefabricated panels which is capable of overcoming, or at least minimizing, the aforementioned problems of connection systems made according to the prior art.

In particular, a purpose of the present invention is to make a connection system for prefabricated panels which is capable of supporting the thermal expansions of the irradiated surfaces, and therefore not inducing thermal load stress upon the structure of the panels.

Another purpose of the invention is that of making a connection system for prefabricated panels which has a very low thermal conductivity, making transmittance calculation corrections superfluous due to the presence of the connection system itself in the panel.

A further purpose of the invention is that of being able to have a connection system which is compatible with prefabricated panels of any shape and size, adapting to any architectural requirement.

Yet another purpose of the invention is that of being able to have a connection system for prefabricated panels which can be easily and efficiently anchored to the structural parts of the panels themselves.

The last but not least purpose of the invention is that of being able to have a connection system for prefabricated panels which is particularly simple and cost-effective to make and to apply.

These and other purposes, according to the present invention, are achieved by making a connection system for prefabricated panels like outlined in claim 1.

Further characteristics of the invention are highlighted in the dependent claims, which are integral part of the present description.

The characteristics and the advantages of a connection system for prefabricated panels according to the present invention shall become clearer from the following description, given as an example and not for limiting purpose, with reference to the attached schematic drawings, in which:

FIG. 4 is a table which illustrates the mechanical properties of a particular embodiment of the element shown in FIG. 2.

Figure 1:
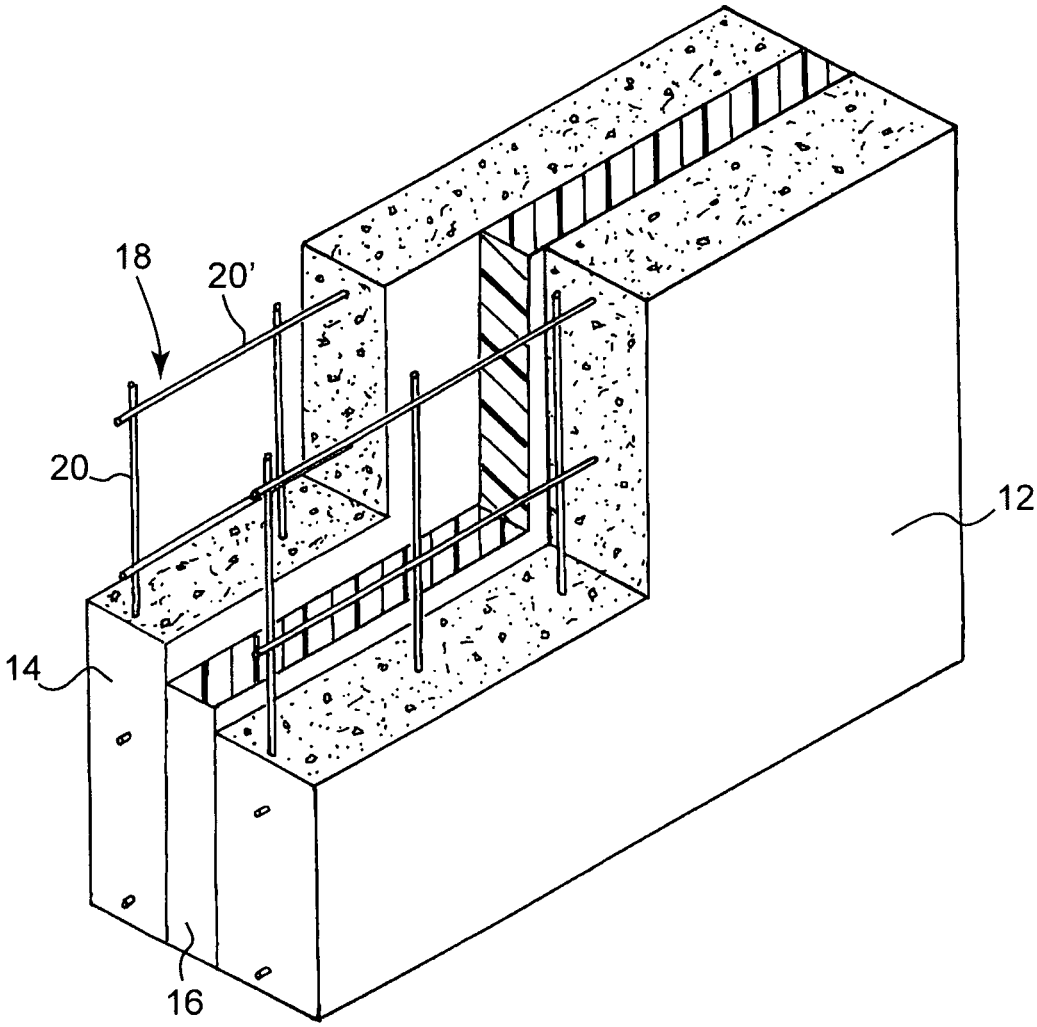
FIG. 1 is a perspective view, partially in section, of a generic prefabricated panel which can be provided with the connection system according to the present invention.
Figure 2A:
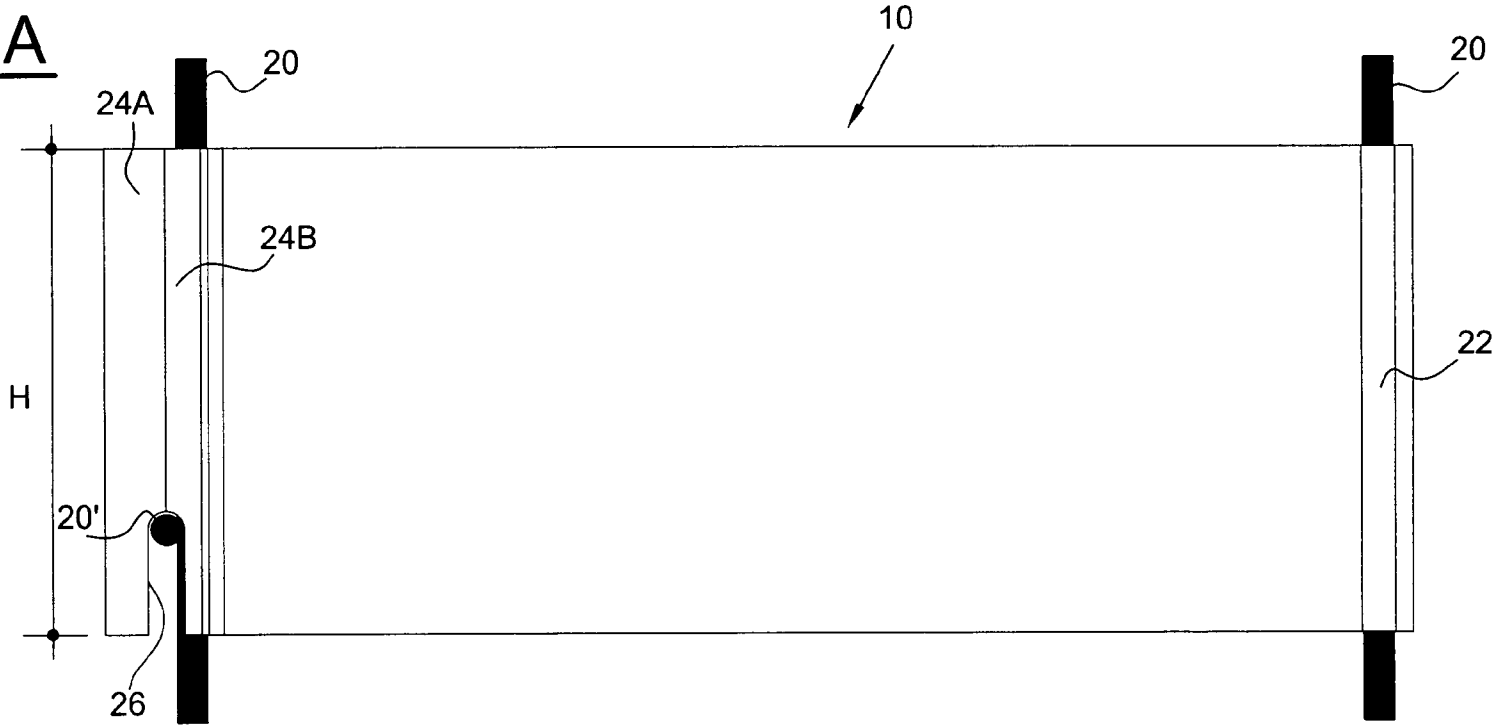
FIGS. 2A and 2B are side elevation views of a first embodiment of an element which is part of the connection system for prefabricated panels according to the present invention, shown in two different assembled configurations.
Figure 3A:
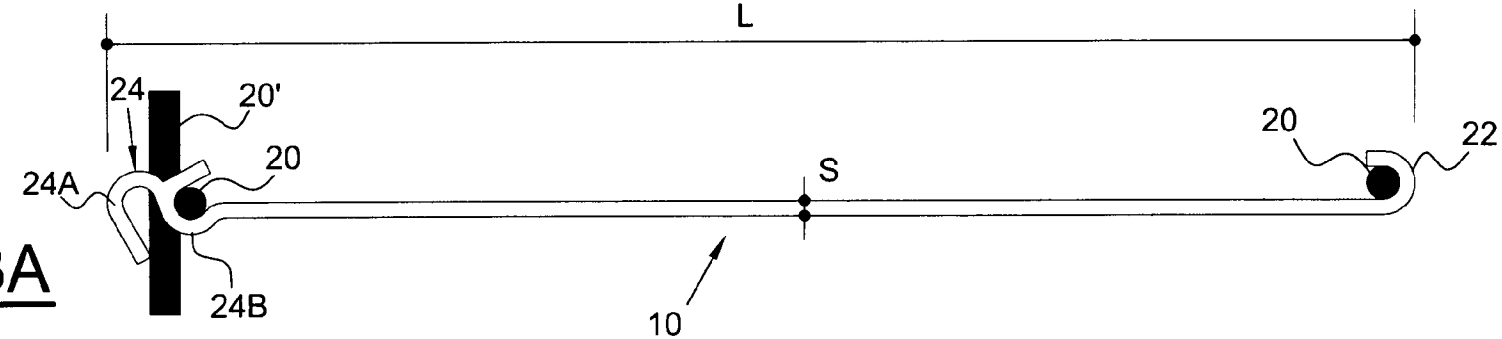
FIGS. 3A and 3B are plan views from above of the elements shown in the configurations of FIGS. 2A and 2B, respectively.
Figure 2B:
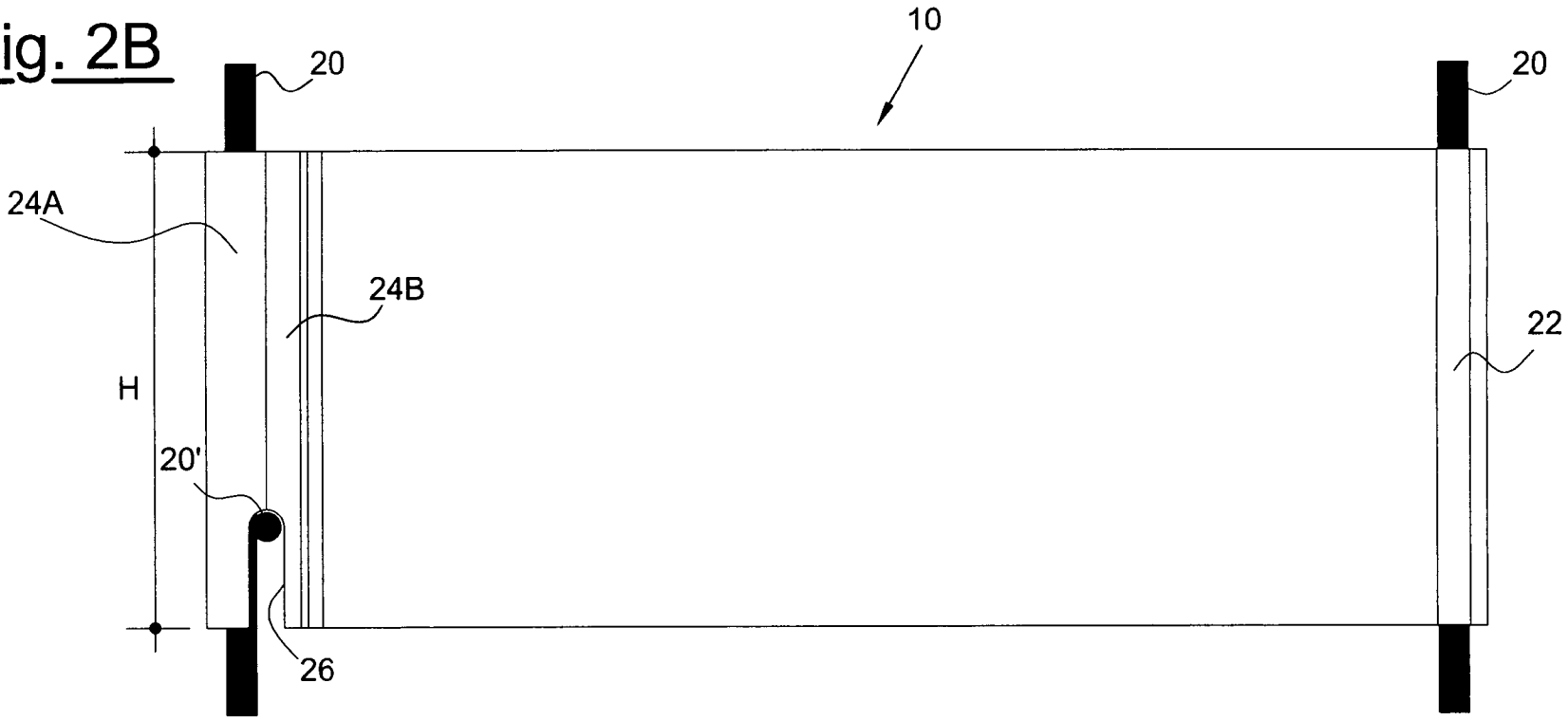
Figure 3B:
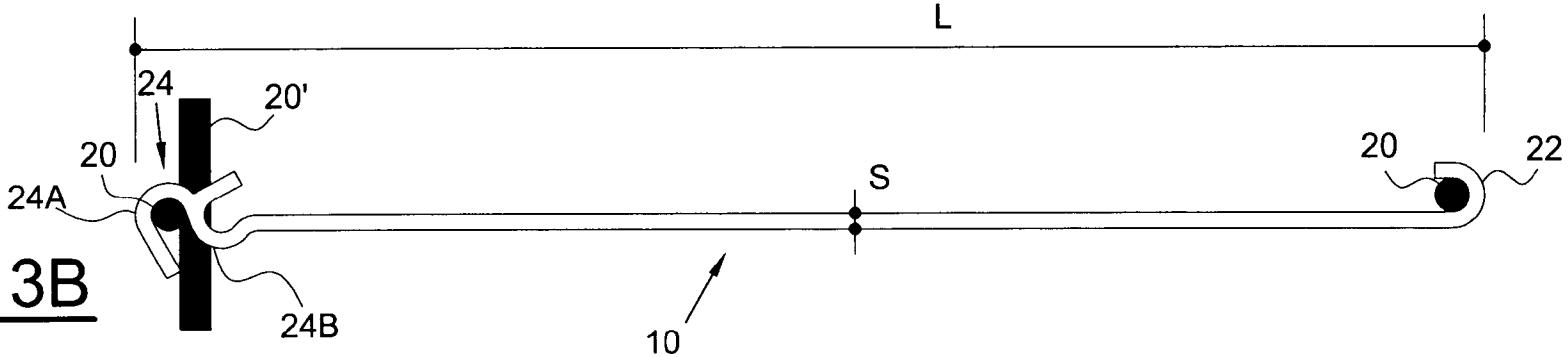

With reference in particular to FIGS. 2 and 3, a first embodiment is shown of one of the single elements which form the connection system for prefabricated panels according to the present invention. Each connection element, wholly indicated with reference numeral 10, is configured so as to be applied to prefabricated panels (FIG. 1) of the type comprising at least two outer concrete layers 12 and 14 and an intermediate layer 16 made of heat-insulating material, arranged between the two outer concrete layers 12 and 14 in a so called "sandwich" configuration. The outer concrete layers 12 and 14 are in turn of the type provided with an inner metal reinforcement 18, made up from a plurality of bars 20, 20' made from steel suitably shaped and connected to one another. For example, the reinforcement 18 can be formed from well known metal cages of electro welded mesh.

Each connection element 10 is made in the form of a preferably rectangular plate, having an overall length L so as to allow it to extend, in an almost orthogonal direction with respect to the extension plane of the prefabricated panel and once the element 10 itself has been applied, through the heat-insulating layer 16 and to be partially inserted inside the concrete layers 12 and 14.

Moreover, each connection element 10 is provided, at two opposed terminal ends, with respective hooking means 22 and 24 at the concrete layers 12 and 14. More precisely, the hooking means 22 and 24 allow each element 10 to remain fixedly connected, once it has been applied, at the bars 20, 20' of the metallic reinforcement 18 foreseen inside the concrete layer 12 (carried layer) and, in some cases, at the bars 20, 20' of the metallic reinforcement 18 foreseen inside the concrete layer 14 (load-bearing layer).

As shown in FIGS. 2 and 3, the hooking means 22 and 24 are made up of C-shaped portions of the opposite terminal ends of the element 10, so that the inner thickness of each C-shaped portion 22 and 24 is substantially equal to the thickness of the bars 20, 20' of the reinforcement 18 to which the element 10 itself can be hooked. It is thus possible to produce elements 10 in which both the length L and the dimensions of the C-shaped hooking portions 22 and 24 can vary, so as to be able to be adapted to a great variety of prefabricated panel types.

According to the invention, at least one of the hooking means 22 and 24 foreseen at the opposite terminal ends of the element 10 is made up of two distinct C-shaped edges 24A and 24B, side by side and parallel to each other and having a length which is substantially equal to the height H of the element 10 itself. Such a pair of C-shaped edges 24A and 24B, formed integral with the element 10, is thus capable of hooking onto respective bars 20, in this case, vertical ones, normally provided on the metallic reinforcement 18 inserted inside the carried outer layer 12 of the panel and, in some cases, also inside the load-bearing layer 14.

At one of the opposite terminal ends of the connection element 10, preferably that on which the pair of C-shaped edges 24A and 24B is formed, there is also provided at least one U-shaped recess 26 adapted to receive therein, by means of bayonet insertion, one of the bars 20' of the metallic reinforcement 18, specifically one of the horizontal bars 20' perpendicular to the bars 20 which are inserted in the C-shaped edges 24A or 24B, so as to allow a suitable hooking of the element 10 at the reinforcement 18. Even in this case, the inner dimensions (width) of the recess 26 are substantially equal to the thickness of the respective horizontal bar 20' to which the element 10 is hooked.

The open side of each of the C-shaped edges 24A and 24B, that is to say, the side in which the bars 20 and 20' of the reinforcement 18 are inserted, can be oriented according to different directions according to the usage requirements of the connection element 10. For example, according to the embodiment shown in FIGS. 2 and 3, the open sides of the pair of the C-shaped edges 24A and 24B are oriented according to substantially perpendicular directions, whereas according to the embodiment shown in FIG. 5 they are oriented according to parallel and opposite directions.

Figure 5:
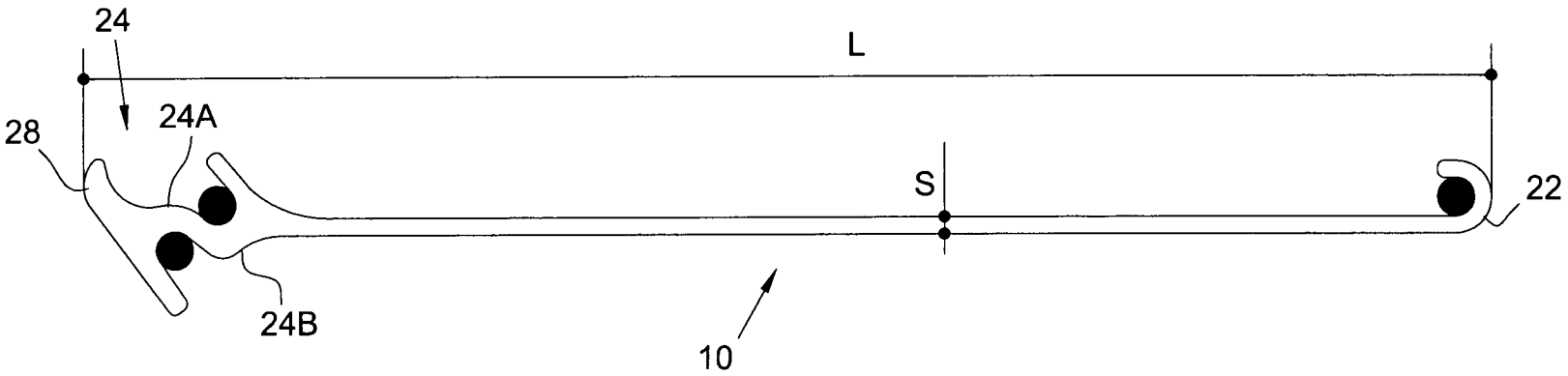
FIG. 5 is a plan view from the top of a second embodiment of an element which is part of the connection system for prefabricated panels according to the present invention.

Based upon the embodiment shown in FIG. 5, the connection element 10 can also be provided with at least one anchoring means 28, hook-shaped or with another shape, made as a single piece with the connection element 10 itself at at least one of its terminal ends. Preferably, the anchoring means 28 is hook-shaped and it is formed on the terminal end of the connection element 10 on which also the two C-shaped edges 24A and 24B are formed, and its function is that of further improving the anchorage capability of the connection element 10 itself inside the concrete layers 12 and 14 of the prefabricated panel.

The particular hooking system of each connection element 10 at the reinforcement mesh 18 of at least one of the outer layers 12 or 14 of the prefabricated panel therefore ensures the maximum hold over time of the elements 10 themselves, which cannot in any way unhook from the corresponding vertical bar 20 and horizontal bar 20'. Consequently, there is the maximum flexibility in managing casting times and the time needed for the subsequent operations necessary to make the panel, as shall be better specified in the rest of the description. A possible premature hardening of the casts of the outer layers 12 or 14, due for example to summertime temperatures, would not indeed compromise the fixing and the hold over time of the elements 10.

All the elements 10 of the connection system according to the present invention are made of plastic material, in particular with a synthetic resin preferably thermosetting, reinforced with fibre glass with a high content of transversal reinforcements. Such a resin makes it possible for the connection elements 10 to resist the attack of the alkalis normally contained in concrete and is thus particularly suitable for being applied into prefabricated panels.

The particular configuration and orientation of the fibreglass inside the matrix of resin allows the elements 10 to contrast the traction, cutting and bending stresses in the direction of maximum stress (usually the direction of the length L), simultaneously allowing flexing for a practically infinite number of cycles in the direction of maximum deformation induced by the thermal expansions. The coefficient of heat transmission of the elements 10 made up of fibre and resin is so low that the effect of the elements 10 for connecting the two outer layers 12 and 14 inserted in the panel can be overseen, for the sake of the overall calculations of the transmittance of the panel. The table of FIG. 4 shows, purely as an example, the mechanical properties of a possible embodiment of an element 10 according to the present invention, fabricated in vinilester resin and with dimensions 216 mm (length L)×2.5 mm (thickness S).

Advantageously, the elements 10 of the connection system for prefabricated panels according to the present invention can be made according to the production process called pultrusion. Such a continuous production process makes it possible to obtain profiles made from composite plastic material having a constant section, of any length and with a rectilinear axis. The reinforcement fibres of the element 10, made in the form of a roving, mat, laths, glass fabrics, carbon fibre, Kevlar, basalt or others, after being impregnated with a suitable polymer matrix (resin, mineral fillers, pigments, additives, etc.), pass through a preforming station which configures the stratification necessary to give the profile the desired properties. The reinforcement fibres impregnated with resin are then suitably heated, so as to obtain the polymerization of the resin. The solid profile thus obtained is ready to be automatically cut to size and machined to make the elements 10 of the desired dimensions.

Thanks to the materials used and to the particular pultrusion production process, the elements 10 can operate in a range of temperatures of exercises ranged between −40° C.

and +120° C. and show a particular fire resistance, since they are made with a thermosetting instead of thermoplastic resin base.

Operatively, the fabrication of a prefabricated panel provided with a connection system like that described above is carried out in the following way.

A first outer layer of concrete 12 is cast, in the specific case the carried layer, and the relative metal reinforcement mesh 18 is positioned. At this point of the productive process, the elements 10 are hooked to the mesh 18, having constant pitch, at the intersections between the vertical bars 20 and horizontal bars 20', such intersections being nodes of maximum resistance of the mesh 18 itself.

Both elements 10 arranged along the longitudinal axis of the panel, and additional elements 10, positioned near to the hooks, to the foot of the panel (for vertical panels) or to the centre line (for horizontal panels), can be fixed to the mesh 18. The hooking is ensured by the combination of the C-shaped portions 22 and 24, which "enclose" the bars 20 oriented along a certain direction, and of the recesses 26, in which the bars 20' are introduced bayonetwise, welded perpendicularly to the bars 20, allowing the elements 10 to autonomously remain in a substantially perpendicular position with respect to that of the extension of the mesh 18 and, consequently, of the plane of the panel as a whole.

The carried layer 12 of the panel is now ready for a second cast of lining of the mesh 18, normally made with a mixture which is different with respect to the first cast for both keeping the costs low (the inerts are structural and not precious), and for giving the crust a higher rigidity. Alternatively, to reduce the number of casts and to speed up the production process, the concrete layer 12 can be made with a single cast, once the connection elements 10 have been properly hooked to the reinforcement mesh 18.

With the first concrete layer 12 of the panel, in this case the carried lining layer, thus completed, the thermal insulating material is positioned for thermal break, usually made up of high density polystyrene. The slabs of polystyrene are suitably cut and/or perforated so as to be passed through by the connection elements 10 previously hooked to the mesh 18. Two distinct layers of thermal insulating material are normally provided for, to allow the thermal expansions which are typical of thermal break panels.

At this point the panel is ready to be reinforced according to design data and for the insertion of the foreseen inserts, like for example the lifting clamps, the suspensions for the horizontal panels or other inserts. The final structural cast, which shall form the last concrete carrying layer of the panel itself, completes the preparation of the panel. The elements 10 remain anchored to the structural cast thanks to the particular configuration of the upper C-shaped ends 22, which hook onto the structural concrete or, for particularly reduced thicknesses of the panel (in the order of, for example, 25 cm overall), to the upper metal reinforcement mesh, contributing to maintaining the position of the mesh itself, which shall avoid surfacing.

It has thus been seen that the connection system for prefabricated panels according to the present invention achieves the purposes previously highlighted, since each of the connection elements which form the connection system itself:

- is suitable for any shape and size of prefabricated panels and adapt to any architectural requirement;
- can be used for making thermal break panels of different thicknesses, aerated panels, ventilated panels, fire-resistant panels, etc.;
- is flexible, supporting the thermal expansions of the irradiated surfaces and not inducing thermal load stresses on the panel structure;
- has a very low thermal conductivity: independently from the quantity of the connection elements used, there is no need for transmittance calculation adjustments;
- can be used for every orientation of the panel, both horizontal and vertical, with or without door and/or window spaces;
- can be also used to make concrete portals and thus ensure the maximum insulation of the entire facade to be made;
- is completely compatible with the most common construction systems and, in particular, with all the inserts intended both for lifting and fixing the panels.

The connection system for prefabricated panels of the present invention thus conceived can in any case undergo numerous modifications and variants, all covered in the same inventive concept; moreover all the details can be replaced by technically equivalent materials. In practice the materials used, as well as the shapes and sizes, can be any according to the technical requirements.

The scope of protection of the invention is therefore defined by the attached claims.

The invention claimed is:

1. A prefabricated panel comprising:

at least two outer concrete layers provided with metallic reinforcement therein, an intermediate layer made of heat-insulating material arranged between the two outer concrete layers, and a connection system comprising a plurality of plate-like connection elements having a length to allow the connection elements to extend in an orthogonal direction, through the heat-insulating layer and to partially penetrate inside the outer concrete layers, each connection element being provided, at two opposed terminal ends, with respective hooking means to the outer concrete layers, the hooking means being provided at a first terminal end of each connection element and being made up of two distinct C-shaped edges, side by side and parallel to each other, said two distinct C-shaped edges hooking to respective bars provided on the metallic reinforcement of at least one of the outer concrete layers, wherein at the terminal end of the connection element opposite that on which said two distinct C-shaped edges are made, the hooking means are made up of at least a C-shaped edge hooking to the outer concrete layer opposite that to which said two distinct C-shaped edges hook, and/or to one of the bars provided on the metallic reinforcement of said outer concrete layer opposite that to which said two distinct C-shaped edges hook, and wherein said at least C-shaped edge and said two distinct C-shaped edges have a length substantially equal to a height of the connection element, wherein the connection elements are made of a thermosetting resin reinforced with fibres and with a high content of transversal reinforcements.

2. The prefabricated panel according to claim 1, wherein at the terminal end of the connection element on which said two distinct C-shaped edges are made, there is also provided at least one U-shaped recess, received therein, by bayonetwise insertion, a respective bar of the metallic reinforcement orthogonal to the bars which are inserted into said two distinct C-shaped edges.

3. The prefabricated panel according to claim 1, wherein said two distinct C-shaped edges are formed integrally with the connection element.

4. The prefabricated panel according to claim 1, wherein the inner thickness of said two distinct C-shaped edges and of said at least C-shaped edge is substantially equal to the thickness of the respective bars of the metallic reinforcement to which the connection element may be hooked.

5. The prefabricated panel according to claim 1, wherein the connection elements are made according to the pultrusion production process.

6. The prefabricated panel according to claim 1, wherein the connection elements have the following characteristics:

specific gravity is about 1.75 $g/cm^3$;

water absorption ≤0.4%;

vitreous content by weight is about 60%;

barcol hardness ≥50° B;

modulus of elasticity (in length) ≥15 GPa;

shear resistance (in length)≥400 MPa;

thermal expansion coefficient (in length) is $11\times10^{-6}$ $K^{-1}$; and thermal conductivity is 0.35 W/mK.

* * * * *